US009907990B2

(12) United States Patent
Januszek

(10) Patent No.: US 9,907,990 B2
(45) Date of Patent: Mar. 6, 2018

(54) ANNULAR WEIGHTED EXERCISE APPARATUS

(71) Applicant: Escape Fitness Limited, Peterborough (GB)

(72) Inventor: Matthew Januszek, Peterborough (GB)

(73) Assignee: Escape Fitness Limited, Peterborough (GB)

( * ) Notice: Subject to any disclaimer, the term of this patent is extended or adjusted under 35 U.S.C. 154(b) by 0 days.

(21) Appl. No.: 14/568,751

(22) Filed: Dec. 12, 2014

(65) Prior Publication Data

US 2015/0165258 A1 Jun. 18, 2015

(30) Foreign Application Priority Data

Dec. 12, 2013 (GB) ..... 1321962.1

(51) Int. Cl.

| | |
|---|---|
| ***A63B 21/06*** | (2006.01) |
| ***A63B 21/00*** | (2006.01) |
| ***A63B 21/072*** | (2006.01) |
| *A63B 71/00* | (2006.01) |

(52) U.S. Cl.

CPC ..... *A63B 21/06* (2013.01); *A63B 21/0004* (2013.01); *A63B 21/00065* (2013.01); *A63B 21/0607* (2013.01); *A63B 21/0608* (2013.01); *A63B 21/072* (2013.01); *A63B 2071/0063* (2013.01); *A63B 2208/0204* (2013.01); *Y10T 29/49826* (2015.01)

(58) Field of Classification Search

CPC ..... A63B 21/0004; A63B 21/072–21/0728; A63B 21/00065; A63B 2071/0063; A63B 2208/0204

USPC ..... 482/92–108

See application file for complete search history.

(56) References Cited

U.S. PATENT DOCUMENTS 903,731 A * 11/1908 Kull ..... A47D 13/043 297/274
1,530,519 A * 3/1925 Remington ..... A63B 69/0059 434/252
3,095,586 A * 7/1963 Baier ..... B63C 9/082 441/81
3,195,890 A * 7/1965 Salls ..... A63B 25/08 482/128
3,593,995 A * 7/1971 Eckstrom ..... A63B 19/00 446/490
3,659,843 A * 5/1972 Kojigian, Jr. .... A63B 23/03575 128/DIG. 15
3,713,299 A * 1/1973 Duncan ..... B63C 11/30 224/664
3,735,598 A * 5/1973 Oeland, Jr. ..... B63C 11/30 405/186
3,765,673 A * 10/1973 Daw ..... A63B 5/11 482/26
3,925,838 A * 12/1975 Kennedy ..... B63C 9/155 441/96

(Continued)

*Primary Examiner* — Stephen R Crow
*Assistant Examiner* — Garrett Atkinson
(74) *Attorney, Agent, or Firm* — Troutman Sanders LLP; Ryan A. Schneider

(57) ABSTRACT

A weighted exercise apparatus including an annular body having axially spaced annular faces and inner and outer side walls, the body section having a core including at least one weight member, a resilient material provided either side of the weight member at least in the axial direction, and a flexible cover layer.

18 Claims, 4 Drawing Sheets

(56) References Cited

U.S. PATENT DOCUMENTS 4,017,927 A * 4/1977 Massey ..... B63C 9/082 264/DIG. 4
4,037,834 A * 7/1977 Oaks ..... A63B 69/0035 482/27
4,366,963 A * 1/1983 Reeves ..... B63B 7/082 280/18.1
4,431,185 A * 2/1984 Cisneros ..... A63B 21/072 220/318
4,464,132 A * 8/1984 Mauck ..... B63C 9/082 441/81
4,516,768 A * 5/1985 Gallaro ..... A63B 21/0004 482/140
4,602,387 A * 7/1986 Zakrzewski ..... A63B 21/065 2/102
4,658,442 A * 4/1987 Tomlinson ..... A63B 21/065 2/102
4,798,497 A * 1/1989 Bloos ..... B63C 11/30 405/185
4,976,642 A * 12/1990 Wilkie ..... B63C 9/082 441/131
5,072,935 A * 12/1991 McWain ..... A63B 21/065 224/148.1
5,076,575 A * 12/1991 Eylander ..... B63C 11/30 405/186
5,433,637 A * 7/1995 Graves ..... A63H 33/18 441/80
6,019,651 A * 2/2000 Driscoll ..... B63C 9/26 441/81
6,113,521 A * 9/2000 Winston ..... A63B 21/065 482/105
6,123,651 A * 9/2000 Ellenburg ..... A63B 71/0036 482/104
6,200,243 B1 * 3/2001 Meranto ..... A63B 21/0602 150/150
6,244,997 B1 * 6/2001 Cook ..... A63B 21/065 482/105
6,500,102 B1 * 12/2002 Domenge ..... A63B 21/065 446/236
6,702,723 B2 * 3/2004 Landfair ..... A63B 21/06 482/106
6,749,548 B2 * 6/2004 Hoffman ..... A61H 1/0218 482/142
7,182,715 B2 * 2/2007 Anderson ..... A63B 21/072 482/108
7,207,929 B2 * 4/2007 Hamilton ..... A63B 21/06 482/106
7,458,920 B2 * 12/2008 Hallar ..... A63B 21/06 206/303
7,517,305 B2 * 4/2009 Lien ..... A63B 21/0728 482/106
7,678,028 B1 * 3/2010 Gore ..... A63B 69/004 482/86
7,967,651 B2 * 6/2011 Koulouris ..... B63C 9/04 441/80
8,128,539 B2 * 3/2012 Dickerson ..... A63B 21/0615 482/106
8,276,351 B1 * 10/2012 Henkin ..... A63B 21/00058 482/89
D672,414 S * 12/2012 Januszek ..... D21/680
8,876,671 B1 * 11/2014 Hurtato, Jr. ..... A63B 69/201 482/87
2001/0019986 A1 * 9/2001 Cook ..... A63B 21/065 482/105
2005/0075221 A1 * 4/2005 Fond ..... A63B 21/0728 482/93
2005/0187075 A1 * 8/2005 Bellamy ..... A63B 21/0004 482/93
2006/0073948 A1 * 4/2006 Lincir ..... A63B 21/06 482/94
2006/0160675 A1 * 7/2006 Brown ..... A63B 21/0605 482/93
2006/0172070 A1 * 8/2006 Cao ..... B41M 7/0027 427/258
2007/0184943 A1 * 8/2007 Davies ..... A63B 21/0724 482/93
2008/0015093 A1 * 1/2008 Helton ..... A63B 69/345 482/83
2010/0317496 A1 * 12/2010 Abranchess ..... A63B 21/0004 482/141
2012/0083396 A1 * 4/2012 Aquino ..... A63B 21/0004 482/131
2013/0184129 A1 * 7/2013 Lovegrove ..... A63B 21/0724 482/107
2013/0316880 A1 * 11/2013 Bosse ..... A63B 21/0728 482/107

* cited by examiner

ANNULAR WEIGHTED EXERCISE APPARATUS

CROSS REFERENCE TO RELATED APPLICATIONS

This application claims the benefit of UK Patent Application No. 1321962.1, filed 12 Dec. 2013, the entire contents and substance of which is hereby incorporated by reference.

BACKGROUND OF THE INVENTION

1. Field of the Invention

The present invention relates to an annular weighted exercise apparatus, and in particular an annular weighted exercise apparatus having a layered core structure.

2. Description of Related Art

New physical training programs are increasingly using unconventional training techniques and equipment to provide original and varied ways of exercising that are both physically challenging and enjoyable. Training programs such as cross-fit or military training use non-standard gym equipment such as ropes, logs and tires to provide weighted resistance during exercise. Tire flipping is once such unconventional exercise in which an athlete lifts a large tire by first placing their fingers and hands under the tire while squatting down. While pulling the tire up with their arms and back the athlete straightens their legs in an explosive movement to lift the tire. The explosive movement must be sufficient to generate enough momentum to enable the athlete to move their hand and arm position to switch from a pulling and lifting action to a pushing motion. In this second position the athlete then pushes the tire, which pivots on its lower edge past the vertical tipping point with the tire then falling forward onto its reverse side in a flat, horizontal position. This process may then be repeated to flip the tire a predetermined number of repetitions or along a predefined distance as required by the training program.

Tires from large vehicles such as lorries or tractors are typically used for tire flipping. The resistance weight of the tire comes entirely from its own construction, being a combination of the weight of the rubber and reinforcement material. The weight is arbitrary as tires are not manufactured in specific weight denominations. The size of the tires also varies significantly depending on availability. It is therefore difficult to provide consistent training across multiple locations, or to provide an athlete with a specific weight domination selected for their ability.

In addition, the used nature of the tires and the material properties of the rubber, means the tires are typically dirty and marking leaving deposits and markings on both the athlete and the floors and walls of the gym space in which they are used. For this reason tires are generally only used in warehouse or industrial type gym environments, rather than commercial gym environments that typically have expensive flooring systems. Tires are also not suited to a commercial gym environment as it has been found that the weight of the tires combined with the surface area and profile of their side faces, means that excessive impact noise, often referred to as 'slap' is generated when the tire is flipped and impacts the floor. This is undesirable for the other gym users, as well as other tenants of the building given that many gyms are located in shared occupancy units.

A further prohibition to the use of tires in commercial gyms is the size of the tires given their limited application. Other than tire flipping, there is very little else that can be done with a tire. It can therefore be difficult to justify the space occupied in the gym by a tire given their limited use, and certainly where multiple tires are required for use in classes.

It is therefore desirable to provide an improved exercise apparatus which allows the training benefits of a tire while addressing the above described problems and/or which offers improvements generally.

BRIEF SUMMARY OF THE INVENTION

According to the present invention there is provided a weighted exercise apparatus as described in the accompanying claims.

In an embodiment of the invention there is provided a weighted exercise apparatus comprising an annular body having axially spaced annular faces and inner and outer side walls, the body section having a core comprising at least one weight member, a resilient material provided either side of the weight member at least in the axial direction, and a flexible cover layer. The term annular refers to a ring shaped body in which a continuous body section surrounds an inner aperture. The term is not limited to a circular body shape and it is contemplated that in certain embodiments the ring may for example be square, or ellipsoidal.

The weighted section of the annular body may advantageously be selectively varied to provide the exercise apparatus with a predetermined weight, enabling a range of apparatus of differing weights to be provided. The resilient layers provided axially either side of the weighted layer provide both cushioning to protect the user from being impacted by the weighted layer, and prevent damage to both the exercise apparatus and the flooring surface when the apparatus is flipped in the manner of a tire.

Preferably the opposing axial ends of the annular body have an axially outwardly facing convex profile extending radially between the inner and outer edges, such that the exercise apparatus has a substantially toroidal shape. It has been found that the convex profile significantly reduces impact noise by minimizing the surface area of the axial outer faces on initial impact.

Preferably the at least one weighted layer comprises a plurality of discrete weight members arranged in an annular spaced array and a plurality of resilient spacer members provided between the weight members. This enables a uniform common weight member to be used with the weight being varied by varying the number of weight members in the array. The spacer members securely locate the weight members while also preventing them from impacting against each other in use thereby preventing damage of the weight members as well as undesirable noise. The ability to use a common uniform weight member simplifies manufacture and lowers cost.

The core may comprise a first weighted layer comprising at least one first weight member and a second weighted layer axially spaced from the first weighted layer and comprising at least one second weight member, at least one central resilient layer located axially between the first and second weighted layers and second and third resilient layers located outwardly of the weighted layers at respective axial ends on the opposing axial sides of the weighted layers to the central resilient layer. Axially spacing the weight members, rather than providing larger weight members in a single layer at the centre of the core, provides a more balanced distribution of the weight which improves the feel of the apparatus when it is being moved in a flipping motion. The layers may be discrete and separable layers or may be interconnected as part of a single or multi part core. The layers may be for example formed about the weight members such as by molding, or voids may be formed in the resilient material to receive the weight members, with the resilient material forming both the resilient layers and the spacer members.

The apparatus preferably comprises a layer of resilient material radially outwardly of the weighted layers at the outer side wall extending circumferentially between the core and the flexible cover layer. This layer provides cushioning of the outer edges of the weight members to protect both the user and apparatus in use.

The apparatus preferably comprises a layer of resilient material radially inwardly of the weighted layers at the inner side wall extending circumferentially between the core and the flexible cover layer. This resilient layer provides cushioning to prevent injury to the user when located within the aperture of the apparatus.

The core preferably comprises fourth and fifth resilient layers located axially outwards of the second and third resilient layers defining the axially outer ends of the core, the fourth and fifth resilient layers each having an axially outwardly facing convex profile extending radially between the inner and outer edges to reduce the impact noise generated by the axial end faces. Alternatively the convex profile may be provided on the outer faces of the second and third layers.

A plurality of handles is preferably located on the axial outer faces. The handles provide additional functionality and enable the apparatus to be lifted and otherwise manipulated in a manner not possible with conventional tires.

At least two of the plurality of handles on each end face are preferably located at substantially diametrically opposed locations. This ensures that when the apparatus is lifted and flipped by gripping a handle, the opposing handle is immediately presented to the user once the apparatus has flipped to the reverse side rather than the user having to adjust their positioning around the apparatus, thereby enabling flipping of the apparatus in a straight line in an uninterrupted manner.

A plurality of handles is preferably provided on the outer wall at circumferentially spaced locations. In addition or alternatively to the end face handles these handles also provide additional functionality and enable the apparatus to be lifted and otherwise manipulated in a manner not possible with conventional tires.

A least two of the plurality of handles on the outer wall are preferably located at substantially diametrically opposed locations.

The apparatus is preferably configured such that a person may stand within the central aperture of the annular body.

A plurality of handles is preferably provided on the inner wall at circumferentially spaced locations. These handles enable the user to lift the apparatus when standing within the aperture of the apparatus by gripping the handles with bent legs and straightening their legs to lift.

At least two of the plurality of handles on the inner wall is located at substantially diametrically opposed locations.

In another aspect of the invention there is provided a method of forming an exercise apparatus comprising forming a layered core comprising an annular weighted layer and annular resilient layers located axially either side of the weighted layer and covering the layered core with a flexible cover to define a weighted annular body having axially spaced annular faces and inner and outer side walls. This layered arrangement allows for a simplified construction that enables the apparatus to be manufactured in a straightforward and low cost manner.

The step of forming the layered core preferably comprises forming the stacked layered core such that it comprises a first weighted layer comprising at least one first weight member and a second weighted layer axially spaced from the first weighted layer and comprising at least one second weight member, at least one central resilient layer located axially between the first and second weighted layers and second and third resilient layers located outwardly of the weighted layers at respective axial ends on the opposing axial sides of the weighted layers to the central resilient layer.

Preferably forming the core comprises arranging a plurality of weight members on one of the second and third resilient layers in a spaced annular array and providing a plurality of resilient spacing members between the plurality of weight members to thereby for the first weighted layer, stacking the at least one central resilient layer on the first weighted layer, forming the second weighted layer by arranging a plurality of weight members on the at least one central resilient layer in a spaced annular array and providing a plurality of resilient spacing members between the plurality of weight members; and stacking the other of the second and third resilient layers on the second weighted layer.

Fourth and fifth resilient layers are preferably located axially outwards of the second and third resilient layers defining the axially outer ends of the core, the fourth and fifth resilient layers each having an axially outwardly facing convex profile extending radially between the inner and outer edges to reduce the impact noise generated by the axial end faces.

The outer side wall and the inner side wall of the core are preferably surrounded with respective layers of resilient material prior to covering the core with the flexible cover.

The resilient layer of any of the above is preferably a closed cell foam.

BRIEF DESCRIPTION OF THE DRAWINGS

Various features and advantages of the present invention may be more readily understood with reference to the following detailed description taken in conjunction with the accompanying drawings, wherein like reference numerals designate like structural elements, and in which.

DETAILED DESCRIPTION OF PREFERRED EMBODIMENTS

Figure 1:
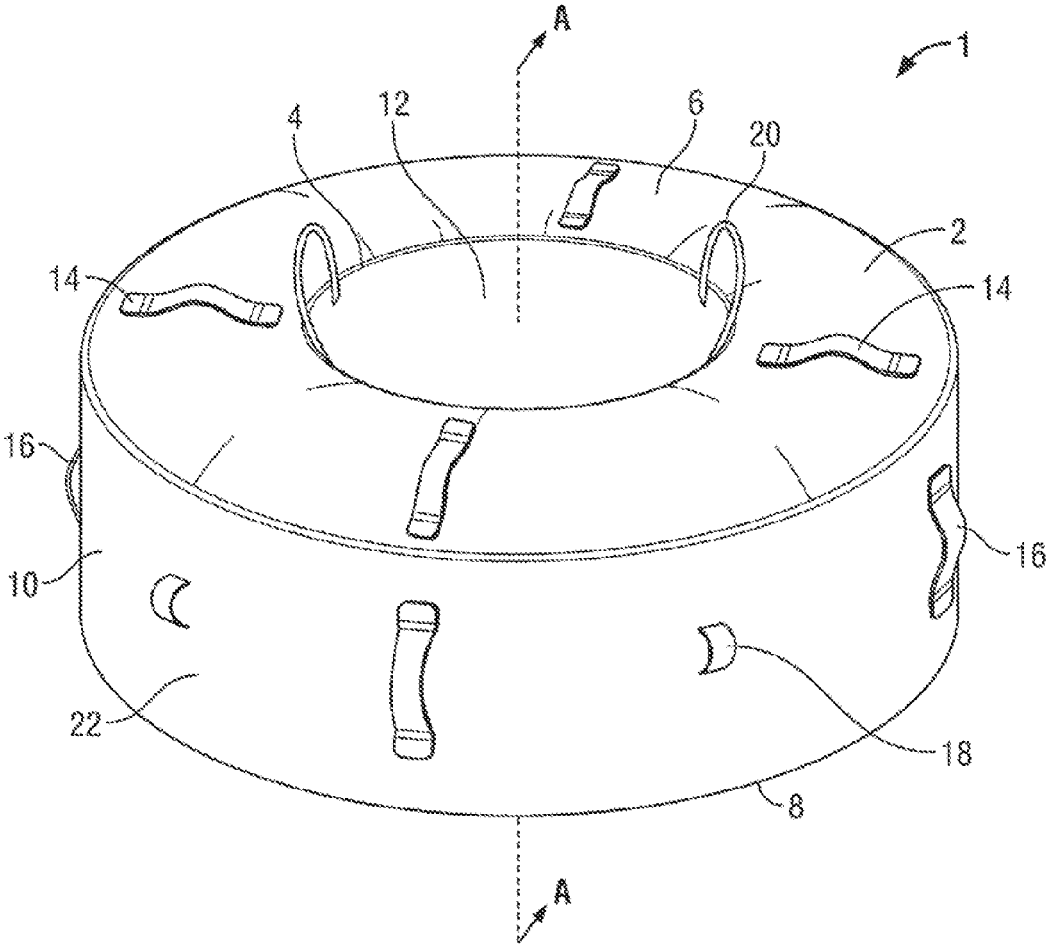
FIG. 1 is an isometric view of an exercise apparatus according to an embodiment of the invention.

To facilitate an understanding of the principles and features of the various embodiments of the invention, various illustrative embodiments are explained below. Although exemplary embodiments of the invention are explained in detail, it is to be understood that other embodiments are contemplated. Accordingly, it is not intended that the invention is limited in its scope to the details of construction and arrangement of components set forth in the following description or examples. The invention is capable of other embodiments and of being practiced or carried out in various ways. Also, in describing the exemplary embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a composition containing "a" constituent is intended to include other constituents in addition to the one named.

Also, in describing the exemplary embodiments, terminology will be resorted to for the sake of clarity. It is intended that each term contemplates its broadest meaning as understood by those skilled in the art and includes all technical equivalents which operate in a similar manner to accomplish a similar purpose.

Ranges may be expressed herein as from "about" or "approximately" or "substantially" one particular value and/or to "about" or "approximately" or "substantially" another particular value. When such a range is expressed, other exemplary embodiments include from the one particular value and/or to the other particular value.

Similarly, as used herein, "substantially free" of something, or "substantially pure", and like characterizations, can include both being "at least substantially free" of something, or "at least substantially pure", and being "completely free" of something, or "completely pure".

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

The materials described as making up the various elements of the invention are intended to be illustrative and not restrictive. Many suitable materials that would perform the same or a similar function as the materials described herein are intended to be embraced within the scope of the invention. Such other materials not described herein can include, but are not limited to, for example, materials that are developed after the time of the development of the invention.

Referring to FIG. 1, an exercise apparatus 1 comprises an annular body 2. The body 2 comprises a central axis A-A. In the arrangement shown in FIG. 1 the annular body 2 is substantially cylindrical having a centrally defined axially extending aperture 4. The body comprises axially opposed end faces 6 and 8, an outer side wall 10 and inner side wall 12, with the aperture 4 extending through the axial end faces. The radial width of the body, being the distance between the outer side wall 10 and the inner side wall 12 is substantially constant.

A plurality of handles 14 are provided on the axial end faces 6 and 8. The handles 14 are loop handles, the construction of which will be described in further detail below. Preferably four handles 14 are arranged in an evenly spaced manner around each annular face 6 and 8 with an angular spacing of 90° between each, with the handles being arranged in diametrically opposed pairs. A plurality of handles 16 is also arranged around the outer side wall 10 in a regularly spaced arrangement. A series of attachment loops 18 are also provided around the outer side wall 10 which provide attachment points for connection to ancillary equipment such as a dragging harness which enables the apparatus to be dragged by the user, or by other equipment such as resilient bands or similar resistance trainers, with connection to the exercise apparatus 1 providing an anchor for the ancillary apparatus.

Further handles 20 are provided on the inner side wall 12. The handles may be configured to form axially extending hoops that enable the apparatus to be lifted in an axial direction by the user when the user is standing within the aperture 4 by gripping the handles 20 in a straight armed grip and lifting with their legs.

Figure 2:
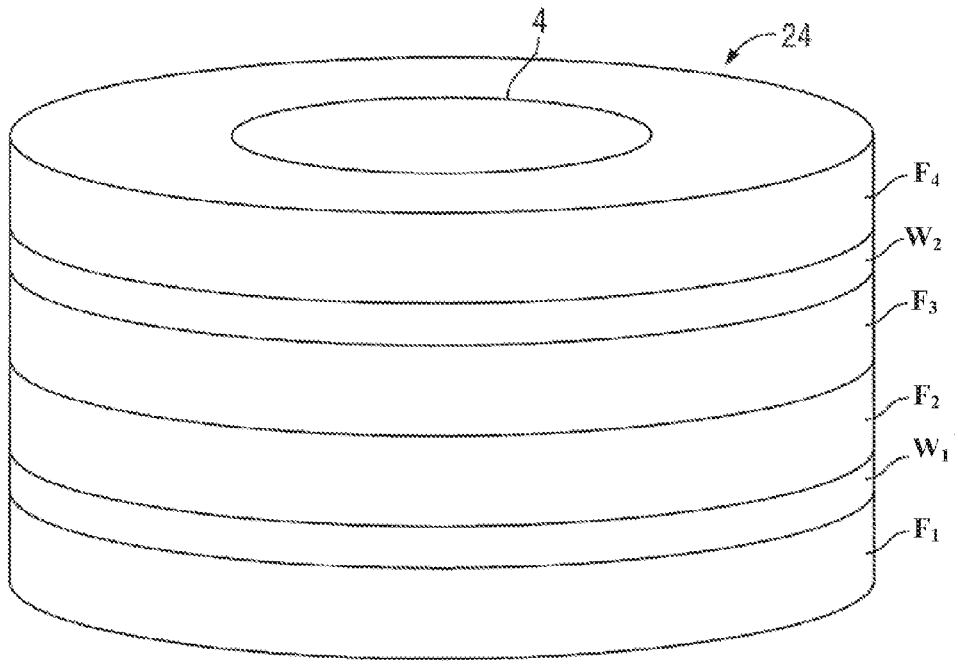
FIG. 2 is view of the core of the apparatus of FIG. 2.

The body 2 comprises a core surrounded by a flexible outer cover 22. FIG. 2 shows a side view of the central construction of the core 24 which is formed from a plurality of stacked layers. The layered core configuration comprises a first annular lower resilient layer $F_1$ that can comprise foam, which in the view shown at FIG. 2 is arranged at the bottom of the stack, although the apparatus may be arranged in any suitable orientation in use and therefore the lower foam layer $F_1$ is not limited to being a lower layer. The foam layers of the core 24 are formed of a closed cell foam. The first lower foam layer $F_1$ has a central aperture 4 corresponding to and forming part of the central aperture 4 of the body 2. A weighted layer $W_1$ is sat adjacently lower foam layer $F_1$. The configuration of the weighted layers will be described in further detail below. The weighted layer $W_1$ is also annular in configuration being the same shape and size as the lower foam layer $F_1$.

Central annular foam layers $F_2$ and $F_3$ are stacked on top of the first weighted layer $W_1$. The central foam layers $F_2$ and $F_3$ are substantially identical to the lower foam layer $F_1$. A second weighted layer $W_2$ is stacked on top of the foam layer $F_3$ and is of the same configuration as the first weighted layer $W_1$. A further foam layer $F_4$ is stacked on top of the second weighted layer $W_2$. The first weighted layer $W_1$ and second weighted layer $W_2$ are therefore both sandwiched between annular foam layers $F_1$ and $F_2$ and $F_3$ and $F_4$ respectively. Each of the layers $F_1$ to $F_4$ are preferably bonded to the adjacent layers by any suitable bonding means.

Figure 3:
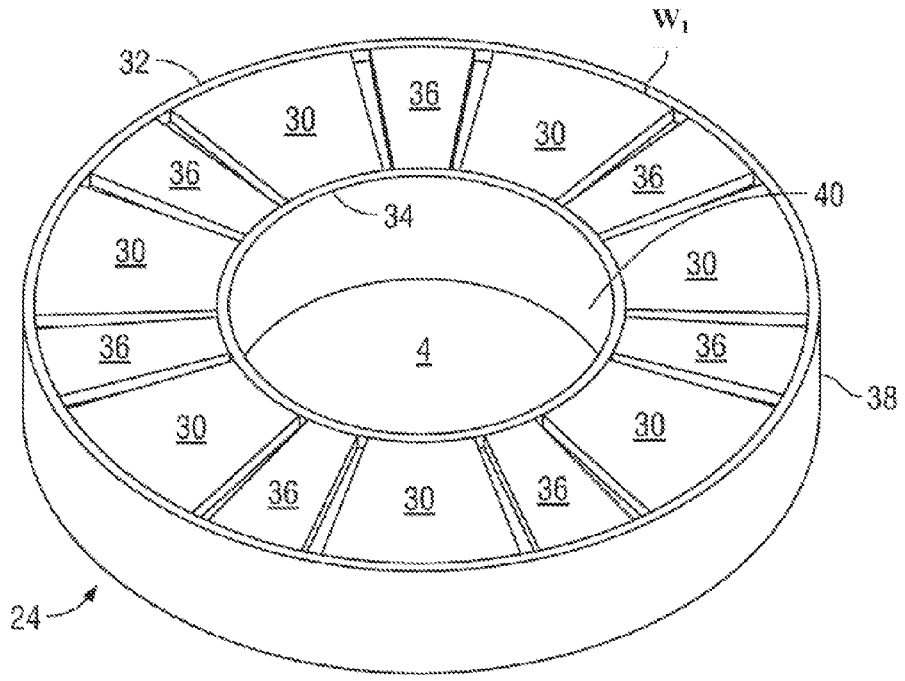
FIG. 3 is a section view of the apparatus of FIG. 1 showing the first weighted layer.

FIG. 3 shows a section view through the core 24 taken at a vertical height coincident with the upper surface of the first weighted layer $W_1$. The description of the first weighted layer $W_1$ is also applicable to the second weighted layer $W_2$. The weighted layer $W_1$ comprises a plurality of weight members 30 arranged in an annular array with each of the weight members 30 being annularly spaced from each other. The weight members 30 are formed in a wedge shape having an outer edge 32 greater in width that the inner edge 34 such that the weight member tappers inwardly in the radially inwards direction. The weight members 30 are blocks of weighted material. The weighted material may be metal or other dense material and is preferably concrete which may be easily molded to the required shape and which is also low cost. In an alternative arrangement a continuous single annular weighted member may be provided. However, the array of weight members 30 enables the apparatus to be more easily assembled with a single operator being able to manually lift the weight members 30 individually whereas a larger single block would be more difficult to form, handle and assemble. The use of multiple weight members 30 also enables the weight of the weight layer $W_1$ to be varied by selectively increasing or decreasing the number of weight members 30 and the annular array.

The weight members 30 are interspaced by resilient spacer members 36. The resilient spacer members can be foam wedges 36, shown in FIG. 3 as being spaced from the weight members 30 for illustrative purposes to more distinguish them as separate elements. However, the foam wedges 36 are preferably closely wedged between the weight members 30 in either a close or interference fit to securely hold the weight members 30 in their annular positions and to provide cushioning between the main weight members to prevent the weight members from engaging each other in use. The side edges of the foam wedges 36 may be bonded or adhered to the corresponding side edges of the weight members 30 although this is not essential.

The annular array of weight members 30 may be varied by altering the number of weight members 30 and correspondingly the number of size of the foam wedges 36 to fill or free up the corresponding spaces between the weight members 30. As also shown in the section view of FIG. 3 a resilient material 38 that can be an outer foam layer 38 is provided around the outer side edge of the core 24. The outer foam layer 38 is formed of a sheet of foam or similar material that is wrapped around the outer surface assembly of the layered construction and preferably bonded thereto. A similar resilient material 40 is provided around the inner edge of the layered arrangement.

Figure 4:
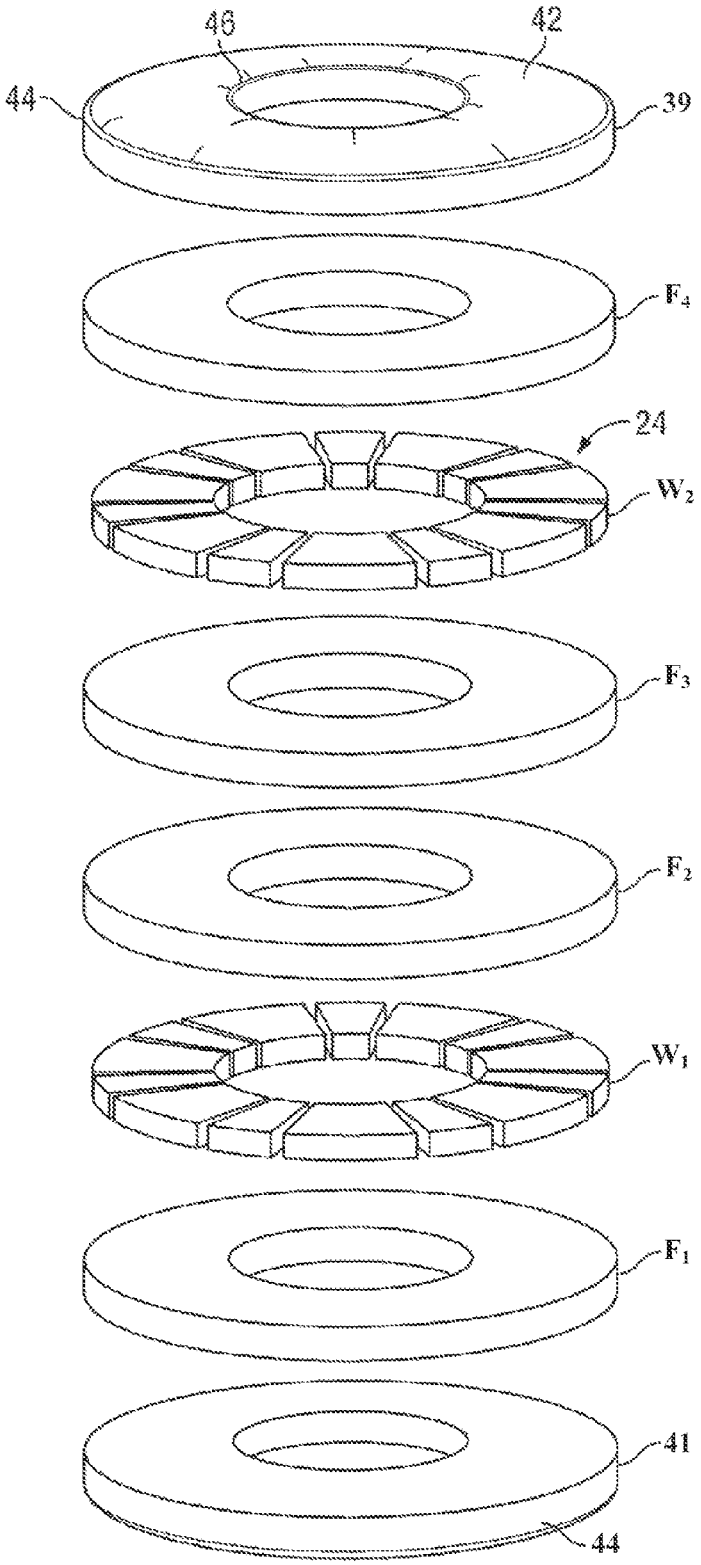
FIG. 4 is an exploded view of the core of the apparatus of FIG. 1.
Figure 5:
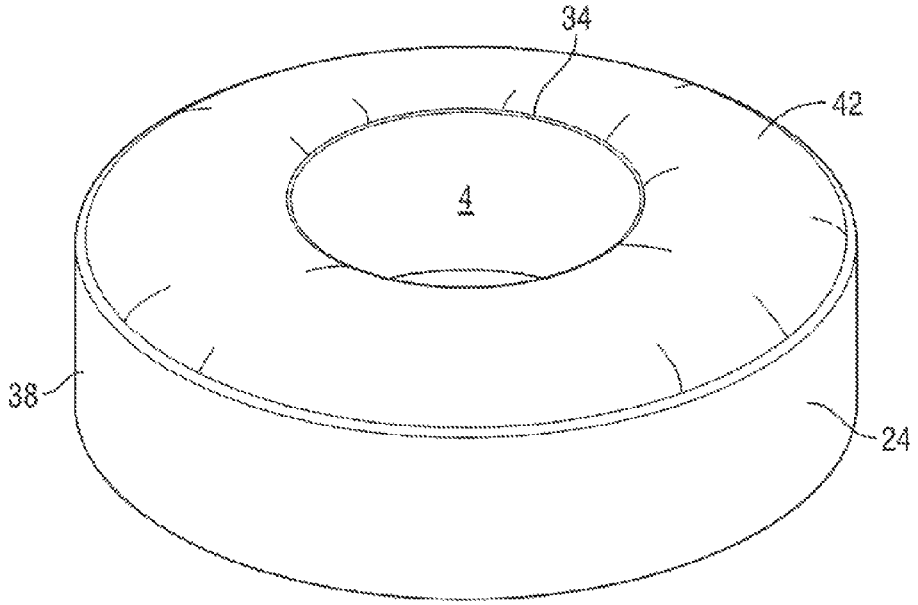
FIG. 5 is a view of the assembled core of the apparatus of FIG. 1.
Figure 6:
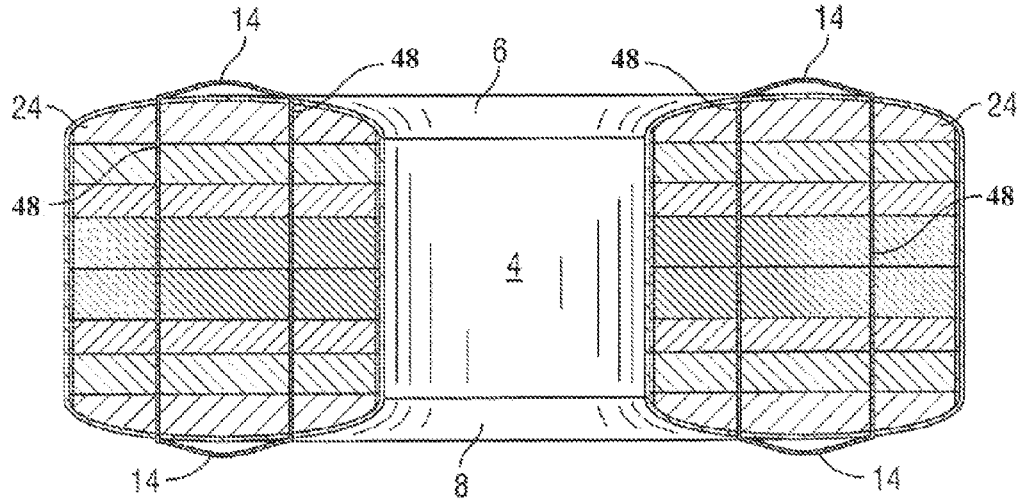
FIG. 6 is a section view of an apparatus according to an embodiment of the invention.

FIG. 4 shows an exploded view of the inner core 24 construction. Additional axial outer layers 39 and 41 are provided at axially opposed ends of the layered core 24. The axial end layers 39 and 41 are also annular in configuration having the same annular shape as the other corresponding layers of the stacked core 24. The axial outer faces 42 have a convex profile with the convex surface extending radially between the outer edge 44 and inner edge 46. The assembled core 24 is shown in FIG. 5 and it can be seen that the convex surfaces 42 to define the axial outer faces of the core 24.

Following assembly of the core 24 a flexible material cover is provided over the core 24 which is stitched, zipped, bonded or otherwise permanently secure in place over the core 24. The cover 22 is preferable formed from a flexible polymeric or other robust material that is selected to be resilient and provide care resistance as well as significant wear resistance.

Due to the weight of the apparatus 1 it is not desirable to secure the handles 14 directly to the cover material 22 as the force required in lifting the apparatus 1 would place undue burden on the connection points between the handles 14 and the cover 22 which could lead to tearing of the cover 22 at these locations. To prevent this issue the handles 14 are formed as a continuous loop extended through the core 24. The handles 14 are formed from a flexible fabric strap or other suitable flexible material. Parallel channels 48 are formed through the layers of the core 24 in a parallel radially spaced arrangement. The channels 48 extend perpendicular to the orientation of the layers of the core 24 in an axial direction and interconnect the axial outer faces of the body 2. The strap defining the handle 14 is passed through a first channel 48 and on existing the first channel 48 is looped and returned into the parallel channel 48 in the opposing direction passed back to the original axial end face into which it entered. The ends of the strap 14 are then joined to form a continuous loop by stitching or other suitable connection means. The handle 14 is then fed through the channels 48 such that the connection point is located within the core 24 such that the exposed sections of the handles 14 are unbroken.

In an exemplary embodiment, the present invention comprises the weighted exercise apparatus 1 comprising the annular body 2 having axially spaced annular end faces 6 and 8, the outer side wall 10, and inner side wall 12, the annular body 2 having a core 24 comprising at least one weight member 30, an inner resilient material 40 provided on an inner edge of the core 24, and an outer resilient material 38 provided on an outer edge of the core 24, and a flexible cover 22.

The weighted exercise apparatus 1 can further comprise the opposing axial ends 39, 41 of the annular body 2, each have an axially outwardly facing convex profile 42 extending radially between inner 46 and outer 44 edges of the axial ends.

The weighted exercise apparatus 1 can further comprise at least one of the weighted layers $W_1$ comprising a plurality of the discrete weight members 30 arranged annularly and spaced from each other by the plurality of resilient spacer members 36.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

What is claimed is:

1. A weighted exercise apparatus comprising:

a toroidal body configured in use to be gripped and lifted by a user as weighted exercise, the toroidal body having its central aperture sized to permit a user to stand within the aperture such that the apparatus may be lifted about the user when using the apparatus, the toroidal body having axially spaced annular end faces and inner and outer side walls, the toroidal body having a core comprising at least one weight member and a resilient material provided either side of the weight member at least in the axial direction; and a flexible cover;

wherein the toroidal body comprises a revolved shape continuously revolved about a line of revolution colinear with a central axis of the central aperture, the revolved shape having a generally uniform cross section about the entirety of the revolution.

2. The weighted exercise apparatus of claim 1, wherein the toroidal body further comprises a resilient material at the inner and outer side walls.

3. The weighted exercise apparatus of claim 1, wherein opposing axial ends of the toroidal body each have an axially outwardly facing convex profile extending radially between inner and outer edges of the axial ends.

4. The weighted exercise apparatus of claim 1, wherein the core comprises at least one weighted layer comprising a plurality of discrete weight members arranged annularly and spaced from each other by a plurality of resilient spacer members.

5. A weighted exercise apparatus comprising:

a toroidal core having its central aperture sized to permit a user to stand within the aperture when using the apparatus comprising:

a first annular weighted layer;

a first annular resilient cushioning layer; and a second annular weighted layer;

wherein the first annular weighted layer is axially spaced from the second annular weighted layer by the first annular resilient cushioning layer disposed between the first and the second annular weighted layers; and wherein each of the first and second annular weighted layers comprise at least one weight member; and a flexible cover;

wherein the toroidal core comprises a revolved shape continuously revolved about a line of revolution colinear with a central axis of the central aperture, the revolved shape having a generally uniform cross section about the entirety of the revolution.

6. The weighted exercise apparatus of claim 5, wherein the toroidal core further comprises axially outer layers provided at axially opposed ends of the layered toroidal core;

wherein the first annular weighted layer, the first annular resilient cushioning layer and the second annular weighted layer are disposed between the axially outer layers; and wherein each axially outer layer has an axial outer face having a convex profile with a convex surface extending radially between an outer edge and an inner edge of the outer layer.

7. The weighted exercise apparatus of claim 5, wherein each of the first and second annular weighted layers comprise a plurality of discrete weight members arranged annularly and spaced from each other by a plurality of resilient spacer members.

8. The weighted exercise apparatus of claim 5 further comprising:

a second annular resilient cushioning layer; and a third annular resilient cushioning layer;

wherein the second and third annular resilient cushioning layers are located outwardly of the first and second annular weighted layers at respective axial ends on opposing axial sides of the first and second annular weighted layers to the first annular resilient cushioning layer.

9. A weighted exercise apparatus comprising:

a toroidal body having its central aperture sized to permit a user to stand within the aperture when using the apparatus, opposed end faces, an outer side wall, and inner side wall, the toroidal body having central axis with an aperture extending through the end faces; and a flexible annular outer cover surrounding the inner and outer side walls and annular end faces of the toroidal body;

the toroidal body comprising a core surrounded by the flexible annular outer cover;

the core comprising:

a first annular weighted layer;

a first annular resilient layer;

a second annular weighted layer;

an inner resilient material provided on an inner edge of the core; and an outer resilient material provided on an outer edge of the core;

wherein the first annular weighted layer is axially spaced from the second annular weighted layer by the first annular resilient layer disposed between the first and the second annular weighted layers; and wherein each of the first and second annular weighted layers comprise a plurality of discrete weight members arranged annularly and spaced from each other by a plurality of resilient spacer members; and wherein the toroidal body comprises a revolved shape continuously revolved about a line of revolution colinear with a central axis of the central aperture, the revolved shape having a generally uniform cross section about the entirety of the revolution.

10. The weighted exercise apparatus of claim 9 further comprising:

a second annular resilient layer; and a third annular resilient layer;

wherein the second and third annular resilient layers are located outwardly of the first and second annular weighted layers at respective axial ends on opposing axial sides of the first and second annular weighted layers to the first annular resilient layer.

11. The weighted exercise apparatus of claim 9 further comprising a plurality of handles located on at least one end face of the toroidal body.

12. The weighted exercise apparatus of claim 9 further comprising a plurality of handles located on the outer side wall of the toroidal body.

13. The weighted exercise apparatus of claim 9 further comprising a plurality of handles located on the inner side wall of the toroidal body.

14. The weighted exercise apparatus of claim 9 further comprising:

at least two handles located on substantially diametrically opposed locations on at least one end face of the toroidal body;

at least two handles located on substantially diametrically opposed locations on the outer side wall of the toroidal body; and at least two handles located on substantially diametrically opposed locations on the inner side wall of the toroidal body.

15. A method of forming a weighted exercise apparatus comprising:

forming an annular layered core comprising a first annular weighted layer and first and second annular resilient cushioning layers, one each located axially either side of the first annular weighted layer; and covering the annular layered core with a flexible cover to define a weighted toroidal body having axially spaced annular faces and inner and outer side walls;

wherein the weighted toroidal body is configured in use to be gripped and lifted by a user as weighted exercise, the toroidal body having its central aperture of generally uniform cross section along its length sized to permit a user to stand within the aperture such that the apparatus may be lifted about the user when using the apparatus;

wherein the toroidal body comprises a revolved shape continuously revolved about a line of revolution colinear with a central axis of the central aperture, the revolved shape having a generally uniform cross section about the entirety of the revolution.

16. The method according to claim 15, wherein forming the annular layered core comprises:

forming the annular layered core such that it comprises the first annular weighted layer comprising at least one first weight member and a second annular weighted layer axially spaced from the first annular weighted layer and comprising at least one second weight member, the first annular resilient cushioning layer located axially between the first and second annular weighted layers and the second and a third annular resilient cushioning layer located, one each, outwardly of the weighted annular layers at respective axial ends on the opposing axial sides of the weighted annular layers to the first annular resilient cushioning layer.

17. The method according to claim 15 further comprising surrounding the outer side wall and the inner side wall of the core with respective layers of resilient material prior to covering the core with the flexible cover.

18. The method according to claim 15, wherein the first annular weighted layer comprises a plurality of discrete weight members arranged annularly and spaced from each other by a plurality of resilient spacer members.

* * * * *